United States Patent [19]

Williams

[11] Patent Number: 4,887,744

[45] Date of Patent: Dec. 19, 1989

[54] DISPENSER FOR A CARBONATED BEVERAGE BOTTLE

[76] Inventor: Forrest D. Williams, 4820 Powell Rd., Fairfax, Va. 22032

[21] Appl. No.: 203,768

[22] Filed: Jun. 8, 1988

[51] Int. Cl.[4] ..... B65D 83/14

[52] U.S. Cl. ..... 222/402.1; 222/402.11; 222/153; 251/353

[58] Field of Search ..... 222/394, 402.1, 402.11, 222/153; 251/353

[56] References Cited

U.S. PATENT DOCUMENTS

| | | | |
|---|---|---|---|
| 232,980 | 10/1880 | Kupfer | 222/394 |
| 2,912,173 | 11/1959 | Edwards | 251/353 X |
| 3,128,924 | 4/1964 | Gorman | 251/353 X |
| 3,229,854 | 1/1966 | Turnquist | 222/67 |
| 3,367,540 | 2/1968 | Lehmann | 222/153 |
| 3,519,171 | 7/1970 | Kinnavy | 222/394 |
| 4,013,197 | 3/1977 | Ewald | 251/353 X |
| 4,341,330 | 7/1982 | Mascia et al. | 222/402.1 X |

FOREIGN PATENT DOCUMENTS

| | | | |
|---|---|---|---|
| 2136056 | 9/1984 | United Kingdom | 222/153 |

*Primary Examiner*—Joseph J. Rolla
*Assistant Examiner*—Boris Milef
*Attorney, Agent, or Firm*—L. Lawton Rogers, III; Joseph M. Killeen

[57] ABSTRACT

A dispenser for a carbonated beverage bottle that uses the pressure from gases released by the beverage to eject the beverage. A plunger is depressed to unseat a check-ball floating in the beverage in a pick-up tube inside the bottle, the check-ball having been seated by gaseous and/or buoyant pressure in a seal to prevent escape of the gas or beverage. The neck and spout of the plunger are hollow, forming a passageway for the beverage to an opening in the spout. Beverage enters the neck of the plunger through opening in the circumferential wall of the neck when the plunger is depressed. Ribs on the interior wall of the seal are in frictional contact with the neck to prevent escape of the gas and the beverage. A tear-away collar permits stacking of the bottles and provides tamper resistance.

23 Claims, 3 Drawing Sheets

DISPENSER FOR A CARBONATED BEVERAGE BOTTLE

BACKGROUND OF THE INVENTION

The present invention relates to a dispenser for a beverage bottle that uses the pressure created from the release of gases trapped in the beverage to eject the beverage. More specifically, it relates to a dispenser with a plunger-displaced check-ball to dispense a carbonated beverage. The invention was disclosed in Disclosure Document No. 180,625 dated Nov. 9, 1987 entitled "Williams Carbonated Beverage Bottle Cap/Dispenser".

Large disposable carbonated beverage bottles are in common use. While they afford an efficient means of storing large quantities of carbonated beverages, they are initially heavy and cumbersome to use. Because gases are released each time the bottle is opened, they also tend to allow the beverage to lose its carbonization and become flat. This can lead to early disposal and waste of the beverage.

Release of gases from carbonated beverage bottles has long been recognized as a problem, and various proposals have been advanced for dealing with the problem. In the approach used in U.S. Pat. No. 3,998,364 to Hollander a flexible pick-up tube extends through the cap and is crimped shut by a spring-loaded plunger. The valve mechanism is on the outside of the bottle, taking up storage room and not permitting vertical stacking of the bottles. The Crockett U.S. Pat. No. 2,685,978 discloses a dispenser that is designed to operate only when the bottle is tilted. Full bottles are heavy and cumbersome to use with this device.

Other examples of beverage dispensers for bottles are disclosed in the Croy, et al., U.S. Pat. No. 3,129,857, Modderno U.S. Pat. No. 3,134,505, and the Martin, et al., U.S. Pat. No. 3,976,221. In contrast to the present invention, each requires special fittings for home pressurization from a cartridge or pump, or requires a special container suitable for factory pressurization.

A device with a plunger-displaced check-ball is disclosed in the U.S. Pat. No. 2,529,808 to Martin. Unlike the present invention, the plunger in Martin '808 is not hollow, and thus cannot convey the fluid through a spout in the plunger.

Collars for dispensing pumps are disclosed in the U.S. Pat. No. 4,377,106 to Workman, et al., U.S. Pat. No. 4,524,888 to Tada, and in U.S. Pat. No. 4,526,283 to Skinner. Such devices do not combine the features of tamper resistance and compressive strength for stacking.

Accordingly, it is an object of the present invention to provide a dispenser which obviates the problems of the prior art and is easy to use and store.

It is another object of the present invention to provide a dispenser that maintains the carbonization of a beverage in a bottle after numerous uses, regardless of whether the bottle is stored vertically or horizontally.

It is yet another object of the present invention to provide a dispenser that does not require lifting of the bottle when dispensing the beverage.

It is yet a further object of the invention to provide a dispenser that, when in place, allows the beverage bottles to be stacked and provides tamper resistance.

These and many other objects and advantages will be readily apparent to one skilled in the art to which the invention pertains from a perusal of the claims and the following detailed description of preferred embodiments when read in conjunction with the appended drawings.

THE DRAWINGS

DETAILED DESCRIPTION OF PREFERRED EMBODIMENTS

Figure 1:
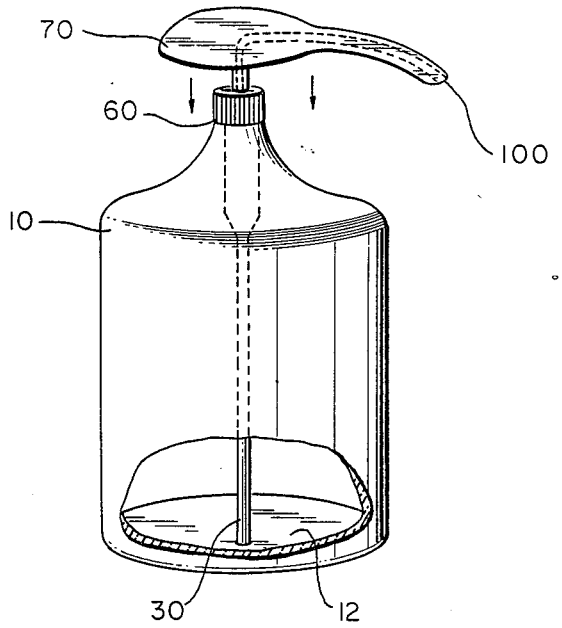
FIG. 1 is a view of a preferred embodiment of the dispenser of the present invention in place on a beverage bottle.

With reference to the figures where like elements have been given the same numerical designation to facilitate an understanding of the present invention, and particularly with reference to the embodiment of the dispenser of the present invention illustrated in FIG. 1, the dispenser is to be sealably attached to the opening on the top of a carbonated beverage bottle 10. The dispenser may be constructed of a pickup tube 30 extending generally to the bottom 12 of the bottle 10, a sealable cap 60, and a plunger 70 extending into the pick-up tube. The operation of the dispenser is effected by depressing the plunger 70 in the direction of the arrows, allowing the pressure generated by the release of gases from the beverage in the bottle to eject fluid through the pick-up tube 30 and out of an opening 100 in the plunger 70.

It is desirable that the dispenser be formed entirely from plastic or similar nonmetallic materials to reduce both weight and manufacturing cost. While it is envisioned that the dispenser may be disposed with the bottle 10, the dispenser also may be reused.

Figure 2:
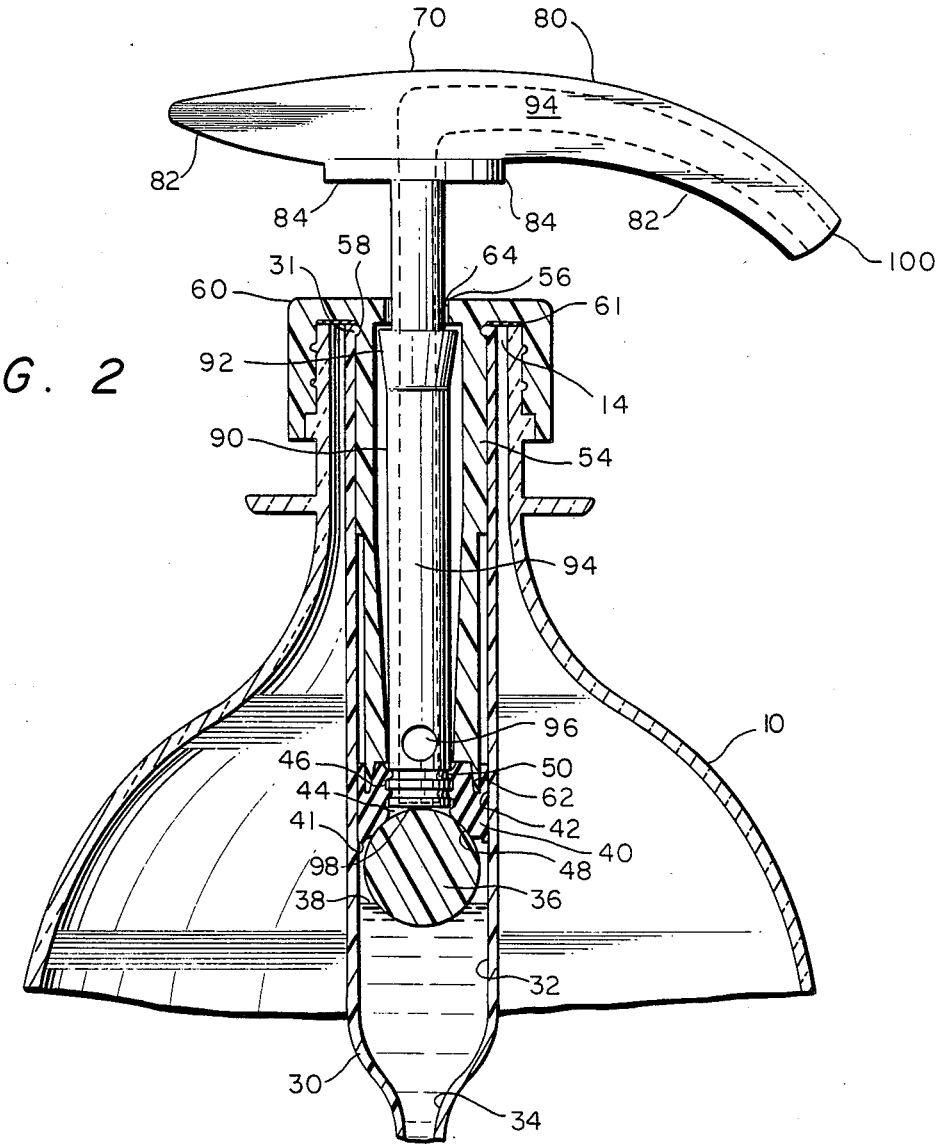
FIG. 2 is a cutaway view of the dispenser of FIG. 1.

With reference now to FIG. 2, the detailed description of the dispenser may be more clearly seen. The pick-up tube 30 is generally cylindrical, having an internally protruding lip 31 adjacent to the opening 14 of the bottle, a first internal diameter 32 in the portion of the pick-up tube near the top of the bottle, and a second, smaller internal diameter 34 in the portion closer to the bottom of the bottle.

A check-ball 36 is inside the pick-up tube 30. The external diameter of the check-ball 36 is smaller than the first internal diameter 32 and larger than the second internal diameter 34, thereby restricting motion of the check-ball 36 down the pick-up tube 30 toward the bottom of the bottle. The radial distance between the external diameter of the check-ball 36 and the first internal diameter 32 regulates the volume of the beverage flow. The check-ball should have a specific density that allows it to float on the surface 38 of the beverage in the pick-up tube. To that end, it may be hollow. It should also be smooth to prevent excessive release of gases trapped in the beverage (i.e., fizzing).

Motion of the check-ball 36 toward the opening 14 is restricted by placement of an annular seal 40 in the portion of the pick-up tube near the top of the bottle. A projection 41 on the internal circumference of the pick-up tube 30 prevents movement of the seal 40 toward the bottom of the bottle.

Figure 3:
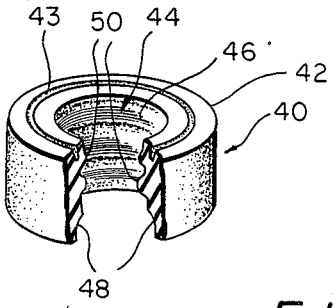
FIG. 3 is a depiction of the annular seal shown in FIG. 2.

The external diameter 42 of the seal sealably abuts the internal diameter 32 of the pick-up tube 30. As may be seen in FIG. 3, the seal 40 has an annular groove 43 on the face closest the opening 14, and an orifice 44 with an inside diameter 46 smaller than the external diameter of the check-ball 36. The face of the seal closest the bottom of the bottle is formed into a seat 48 conforming to the shape of the check-ball 36. The seat 48 and check-ball 36 generally form an air-tight seal over the orifice when the check-ball 36 is seated in the seat 48 and held in place by the internal gaseous pressure and/or the buoyancy of the ball 36. The seal 40 has one or more ribs 50 extending completely around the internal circumference 46 of the orifice 44. It is desirable that the seal 40 be constructed of malleable plastic, rubber, or like material to improve its sealing qualities.

With reference again to FIG. 2, the cap 60 includes a tube-like main body 54 extending into the pick-up tube 30. The cap 60 is sealably attachable to the external circumference of the opening 14 of the bottle. The cap 60 may be attached to the bottle 10 with annular ridges (37 in FIG. 4) for snapping on the cap or may be of the conventional twist type when the dispenser is to be reused. The cap may also have tamper-proof features when the dispenser is to be discarded with the bottle. In either case, or in any alternative attachment means, the seal between the cap 60 and the bottle 10 should be air-tight. Seal 61 may be provided between the cap and the bottle. The cap 60 includes an aperture 64 coincident with the opening of the main body 54. The cap has a lip 56 extending into the aperture 64 over the opening of the main body.

The main body 54 extends into the pick-up tube 30 and is sealably adjoined with the seal 40. A groove 58 in the circumference of the main body 54 adjacent the bottle opening 14 receives the lip 31 of the pick-up tube 30. When meshed, the groove 58 and lip 31 hold the pick-up tube in place, and combine with the projection 41 and main body 54 to hold the seal 40 in place. The lip 31 may be scored to permit expansion of the lip so that it fits over the main body 54 during assembly. The internal diameter of the main body 54 may be tapered and should act to align the plunger 70 with the orifice 44 when the plunger 70 is depressed during operation of the dispenser. The end of the main body 54 adjoining the seal 40 may have an annular projection 62 to effect an air-tight joining with the groove 43 in the seal 40. The pick-up tube 30, the annular seal 40, the aperture 64, and the main body 54 are generally coaxial.

The plunger 70 has a spout 80 and a neck 90 extending through the aperture 64 into the main body 54. The spout 80 may have one arm or two distal arms 82 of equal or disproportionate length. One or both of the arms 82 may be broad enough to generally conform to the palm of a user's hand for easier use of the plunger (i.e., about an inch in diameter). The spout 80 may be constructed so as to provide a finger-hold 84 under the spout 80 and around the neck 90 so the dispenser may also be used as a handle.

The neck 90 may be cylindrical, having an external diameter such that the neck will frictionally contact the ribs 50 of the seal 40 throughout the range of motion of the plunger 70. The frictional contact between the ribs 50 and the neck 90 should be sufficient to provide an air-tight seal and to allow the gaseous and/or buoyant pressure of the check-ball 36 to force the plunger 70 away from the bottom of the bottle when the plunger is released after use. The neck 90 may also have annular indentations (more clearly seen as 49 in FIG. 4) corresponding to the ribs 50 to provide a tighter seal. The shape of the seat 48 permits the check-ball 36, when seated by gaseous and/or buoyant pressure, to push the neck 90 upward and engage the ribs 50 with the indentations 49.

The neck 90 has a stopper 92 which contacts the lip 56 to prevent removal of the plunger 70 from the main body 54. The stopper 92 may have a ramp to permit insertion of the plunger 70 during fabrication of the dispenser. The range of motion of the plunger 70 is defined by the stopper 92 and the bottom of the spout 84.

The plunger 70 has a chamber 94 extending into the neck 90, through one arm 82 of the spout 80, and connecting with the opening 100 at the end of the arm. The chamber 94 exits the neck 90 through one or more openings 96 in the circumferential wall of the neck 90. Two openings 96 are preferred. The openings 96 are inside the main body 54 when the plunger 70 is fully extended and closer to the bottom of the bottle than the ribs 50 when the plunger 70 is fully depressed. The face 98 of neck 90 facing the bottom of the bottle is not provided with an opening.

The cross-sectional area of the chamber 94 perpendicular to the direction of flow through the chamber at the opening 100 may be larger than the corresponding cross-section in the neck 90 to prevent excessive release of gases in the beverage and to decrease beverage velocity as it exits opening 100. To this end, it is desirable that the cross-sectional area of the chamber 94 gradually expand from the neck 90, through the spout 80 to the opening 100.

Figure 4:
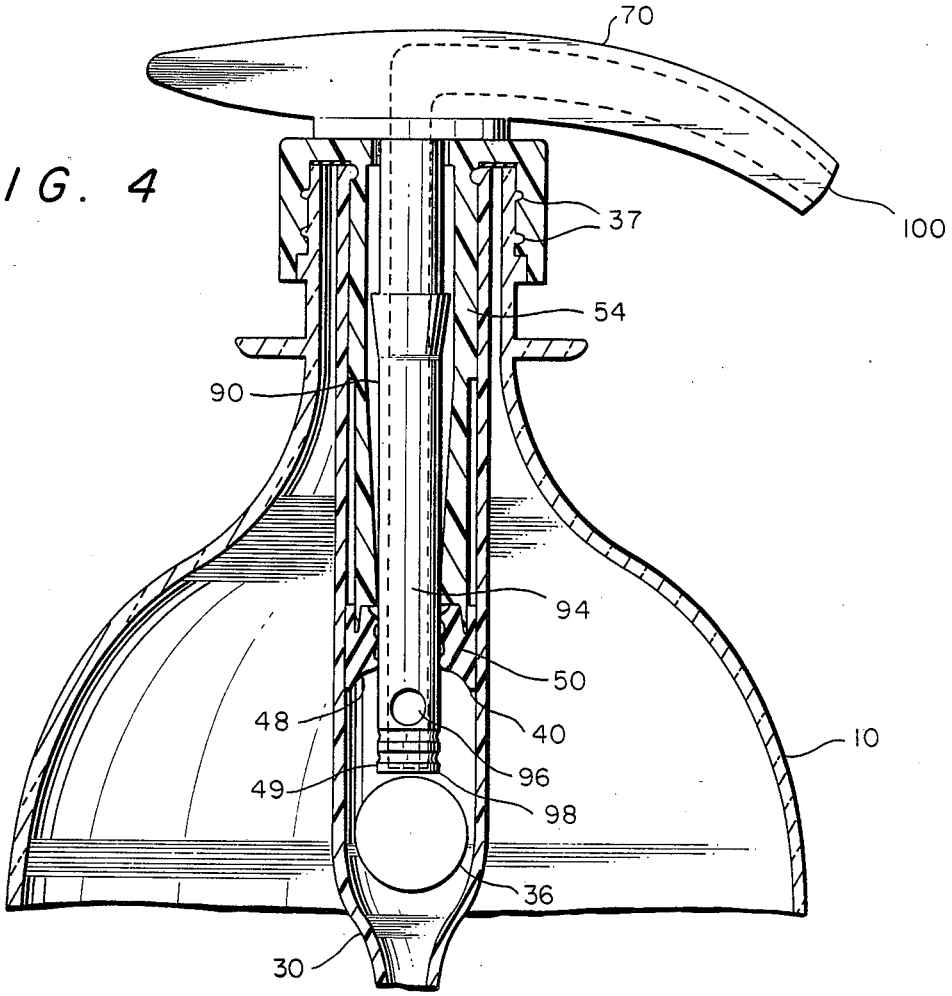
FIG. 4 is a depiction of the dispenser of FIG. 2 with the plunger depressed.

As seen in FIG. 4, when the plunger 70 is fully depressed, the face 98 of the neck 90 displaces the check-ball 36 from its seat 48 in the seal 40. Beverage in the bottle is ejected through the pick-up tube 30 by pressure from released gases in the beverage and enters the chamber 94 through openings 96. The beverage exits the chamber 94 through the opening 100 The frictional contact between the ribs 50 and the neck 90 seals the interior of the main body 54 preventing escape of the beverage into the main body 54. The check-ball 36 is reseated in seat 48 by gaseous and/or buoyant pressure when the plunger 70 is released.

Figure 5:
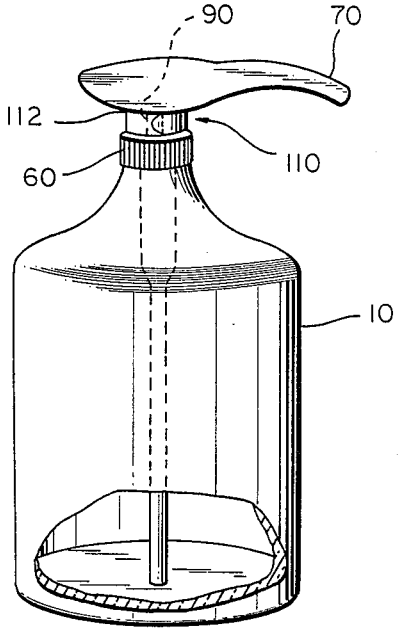
FIG. 5 is a depiction of the dispenser of FIG. 1 with a neck collar.

As seen in FIG. 5, the neck 90 may also have a tear-away collar 110 attached to the plunger 70 for stacking and tamper protection. The height of the collar 110 restricts motion of the plunger 70 toward the bottom of the bottle 10.

Figure 6:
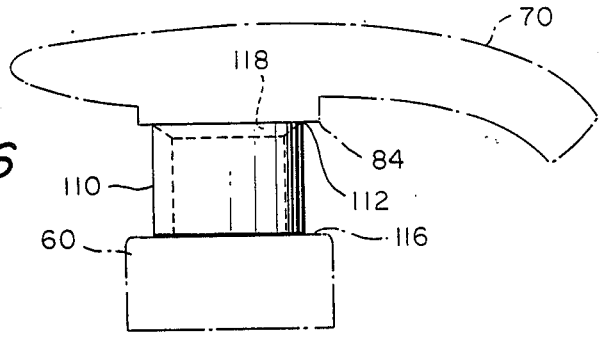
FIGS. 6 and 6A are depictions of the neck collar of FIG. 5.
Figure 6A:
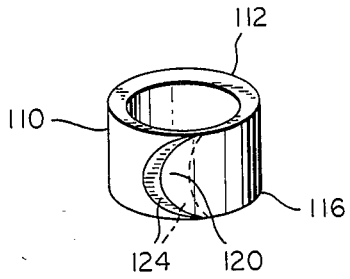

The collar 110 as seen in FIGS. 6 and 6A is a tube with an upper rim 112 nearest the finger-hold 84 that is attached to the plunger 70, and lower rim 116 adjacent the cap 60 that may be unattached. The edge of the upper rim 112 is beveled 118 at approximately 50 to 60 degrees to produce a narrow attachment seam with the plunger that may be continuous or perforated. The lower rim 116 should be flat to conform to the cap 60 and to provide additional compressive strength for stacking. A tear-away tab 120 is formed on the external circumference of the collar. The tab 120 is arcuate with an outer surface that does not extend beyond the external circumference of the collar. The distal ends of the tab extend to the upper and lower rims 112 and 116. A space 124 is evacuated beneath the tab and beyond the apex of the tab to allow the tab to be pulled away from the plunger, thereby tearing the attachment with the plunger and removing the collar. The use of only one rim of the collar for attachment permits the attachment seam to be thick enough to provide sufficient compressive strength for stacking without disenabling the tamper resistant tear-away feature.

Figure 7:
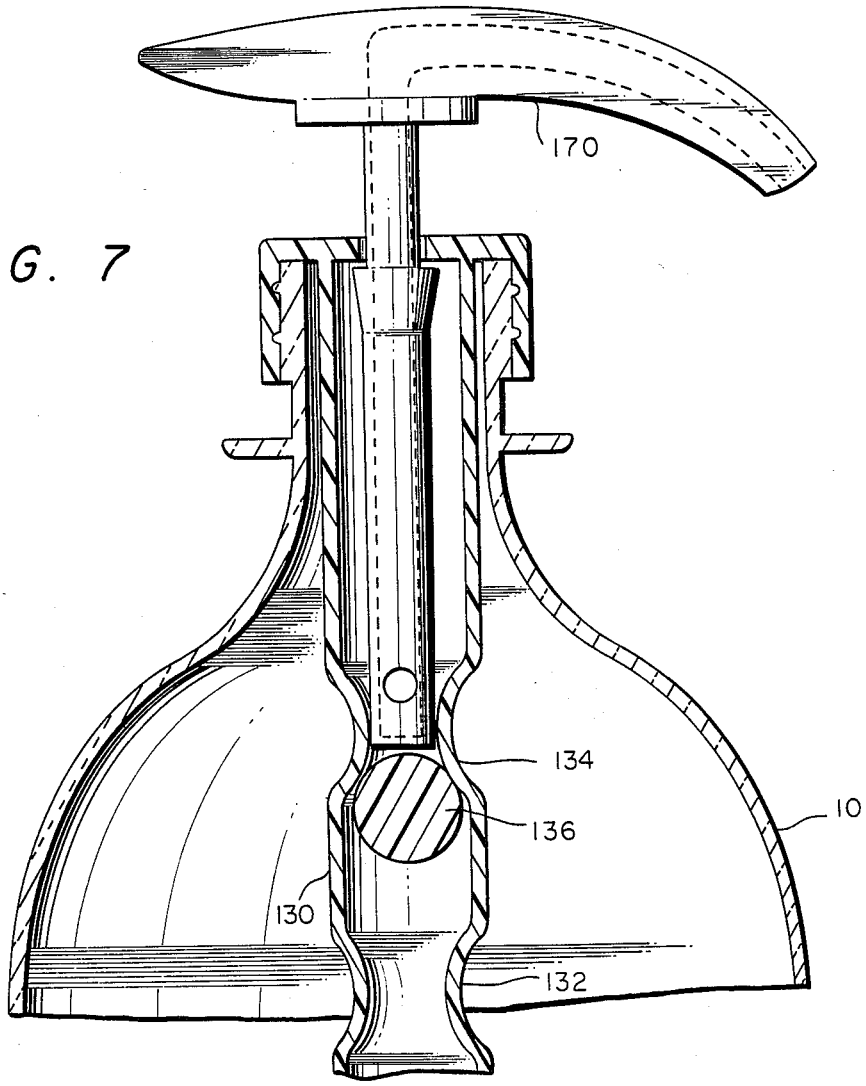
FIG. 7 is an alternative embodiment of the present invention.

In another embodiment seen in FIG. 7, the pick-up tube 130 may be of generally uniform internal diameter. The tube 130 may be crimped 132 with a clip or collar (not shown) to prevent movement of the check-ball 136 toward the bottom of the bottle 10. The seal (40 in FIG. 2) may be replaced by a second crimping 134. The crimping 134 forms the frictional contact created by the ribs (50 in FIG. 2) and aligns the plunger 170. The cap, main body, and pick-up tube as described in relation to FIG. 2 (60, 54, and 30 in FIG. 2) may form a single unit 130. The plunger 170 and check-ball 136 are as descried in relation to FIG. 2.

While preferred embodiments of the present invention have been described, it is to be understood that the embodiments described are illustrative only and that the scope of the invention is to be defined solely by the appended claims when accorded a full range of equivalence, many variations and modifications naturally occurring to those skilled in the art from perusal hereof.

What is claimed is:

1. A dispenser for a carbonated beverage bottle having an opening at its top that uses the pressure created by the release of gases from a carbonated beverage to expel said beverage, comprising:

a pick-up tube internal to said bottle extending generally from near the bottom of said bottle to said opening, having a first internal diameter adjacent said opening and a second internal diameter adjacent said bottom, said first internal diameter being larger than said second internal diameter;

a check-ball internal to said pick-up tube having a specific density such that it will float on a carbonated beverage and having an external diameter larger than said second internal diameter and smaller than said first internal diameter;

an annular seal internal to said pick-up tube having an orifice with an interior side having a diameter smaller than said external diameter, an indented seat surrounding said orifice on the face of said seal nearest said bottom for sealably seating said check-ball, an outside diameter equal to said first internal diameter, and having a first plurality of circumferential ribs on said interior side;

a cap having an aperture and having means for securing said cap onto said opening for forming an air-tight seal with said bottle;

a tubular main body internal to said pick-up tube attached to said cap and being sealably connected to said annular seal at the end of said main body opposite said cap;

said pick-up tube, annular seal, aperture, and main body being generally coaxial;

a plunger for displacing said check-ball from said indented seat and for conveying a beverage from said bottle, comprising:

a cylindrical neck internal to said main body and extending through said aperture having an external surface adjacent said annular seal that is in frictional contact with said ribs whereby an air-tight seal is formed between said neck and said annular seal, said neck having an external diameter adjacent said cap that is smaller than said aperture and having an annular stopper with a diameter larger than said aperture for preventing said neck from being removed from said frictional contact, a spout external to said bottle attached to said neck, and a chamber of non-uniform circumference extending through at least one opening in the circumferential surface of said neck and through said spout, said chamber having a larger circumference in said spout than in said neck;

whereby when said plunger is depressed said check-ball is displaced from said indented seat creating a passageway for a beverage through said pick-up tube, said orifice, said chamber, and out of said spout.

2. The dispenser as defined in claim 1 wherein said plunger further comprises a removable annular collar for preventing movement of said plunger toward said bottom.

3. The dispenser as defined in claim 2 wherein said collar comprises:

a tubular collar having an upper edge attached to said plunger and a lower edge conforming to said cap;

said upper edge being beveled, forming a frangible attachment with said plunger; and a tab formed on and not extending beyond the external surface of said tubular collar, said tab being arcuate and having distal ends at said upper and lower edges, the area beneath said tab and adjacent the apex of said tab being evacuated for pulling said tab and removing said collar.

4. The dispenser as defined in claim 1 further comprising gripping means for holding said pick-up tube adjacent said cap, comprising an annular indention at the top of said main body adjacent said cap corresponding to an annular projection at the top of said pick-up tube.

5. The dispenser as defined in claim 1 wherein said means for securing said cap comprises threads for twist-type attachment to said bottle.

6. The dispenser as defined in claim 1 wherein said means for securing said cap comprises annular ridges for snap-on attachment to said bottle.

7. The dispenser as defined in claim 1 wherein said spout has two distal arms and wherein said chamber extends through one of said arms.

8. The dispenser as defined in claim 1 wherein said annular seal further comprises an annular groove in the face of said annular seal closest said opening.

9. The dispenser as defined in claim 8 wherein said main body further comprises an annular projection on the end of said main body opposite said cap corresponding to said annular groove for sealably connecting said main body and said annular seal.

10. The dispenser as defined in claim 1 wherein said annular stopper is tapered on the side of said annular extension closest said bottom.

11. The dispenser as defined in claim 1 wherein said pickup tube further comprises an annular projection lip internal to said pick-up tube for holding said annular seal in position.

12. The dispenser as defined in claim 1 wherein the external surface of said neck adjacent said annular seal comprises said first plurality of indentations corresponding to said ribs.

13. A dispenser for a bottle comprising:

pick-up means for conveying a beverage from the interior of said bottle to an opening at the top of the bottle and being air-tightedly sealed with said top;

a check-ball internal to said pick-up means;

a movable plunger extending through said opening having a columnar neck internal to said pick-up means, a spout external to said bottle, and a chamber through the circumferential surface of said neck to and through said spout;

said neck having stopper means to limit neck motion out of said pick-up means; and said pick-up means comprising sealing means for creating an air-tight seal between said pick-up means and said neck throughout the range of movement of said neck, means for restricting movement of said check-ball between said sealing means and a portion of said pick-up means, and means for air-tightedly sealing said top that is sealably connected to said sealing means.

14. The dispenser as defined in claim 13 wherein said pick-up means comprises a pick-up tube of nearly uniform diameter having at least one crimped portion for restricting movement of said check-ball within said pick-up tube.

15. The dispenser as defined in claim 14 wherein said sealing means comprises a portion of said pick-up tube having an internal surface that is in frictional contact with the external surface of said neck.

16. The dispenser as defined in claim 13 wherein said means for air-tightedly sealing said top comprises a removable cap sealably attached to said top having an unsealed aperture for said plunger.

17. The dispenser as defined in claim 13 wherein said check-ball is hollow.

18. The dispenser as defined in claim 13 wherein said sealing means comprises:

an annular ring with an orifice having an interior diameter smaller than said check-ball, at least one rib extending inward radially around the interior of said orifice, and an indented seat that conforms to the shape of said check-ball on the face of said ring facing said bottom.

19. The dispenser as defined in claim 13 wherein said spout comprises a generally flat surface approximately one-inch in diameter for moving said plunger.

20. The dispenser as defined in claim 13 further comprising a tubular collar for preventing movement of said plunger, said collar being attached to said plunger with a frangible seam and having a tab not extending beyond the external diameter of said collar for tearing said seam.

21. A dispenser for dispensing a liquid from a pressurized bottle comprising:

a pick-up tube internal to said bottle for conveying a liquid;

a plunger having a neck internal to said pick-up tube and a spout external to said bottle for conveying liquid from said pick-up tube out of the bottle;

a check-ball internal to said pick-up tube;

an annular seal internal to said pick-up tube in frictional contact with said neck having on a first face opposite the top of the bottle a seat for said check-ball;

a cap for air-tightedly sealing said bottle, said cap comprising:

a top for the bottle with an aperture for said plunger, a main body internal to said pick-up tube sealably connected to said top, said main body being sealably connected to the second face of said annular seal opposite said first face, whereby, when said plunger is raised, an airtight seal is created by said top, main body, annular seal, and check-ball seated in said seat, and when said plunger is depressed, liquid is ejected from said spout and an airtight seal is created by said top, main body, annular seal, and said neck in frictional contact with said annular seal.

22. The dispenser as defined in claim 21 wherein said annular seal further comprises an annular groove in said second face for sealably receiving said main body.

23. The dispenser as defined in claim 22 wherein said main body further comprises an annular projection corresponding to said groove in said seal for connecting said main body to said seal.

* * * * *